US007631863B2

(12) United States Patent
Förch et al.

(10) Patent No.: US 7,631,863 B2
(45) Date of Patent: Dec. 15, 2009

(54) SHEET PROCESSING MACHINE HAVING AN APPARATUS FOR REMOVING SELECTED SHEETS

(75) Inventors: Peter Förch, Neustadt (DE); Markus Möhringer, Weinheim (DE); Paul Nicola, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 324 days.

(21) Appl. No.: 11/340,210

(22) Filed: Jan. 26, 2006

(65) Prior Publication Data

US 2006/0163800 A1 Jul. 27, 2006

(30) Foreign Application Priority Data

Jan. 26, 2005 (DE) ..... 10 2005 003 588

(51) Int. Cl.
*B65H 29/04* (2006.01)

(52) U.S. Cl. ..... 271/204; 271/69; 101/232; 101/407.1; 101/408; 198/470.1

(58) Field of Classification Search ..... 271/204, 271/82, 85, 69; 101/232, 407.1, 408, 409; 198/470.1, 803.7, 626.1, 604, 803.9
See application file for complete search history.

(56) References Cited

U.S. PATENT DOCUMENTS

| | | | | |
|---|---|---|---|---|
| 3,652,083 | A * | 3/1972 | Bosshardt | 271/116 |
| 4,127,265 | A * | 11/1978 | Wirz et al. | 271/260 |
| 4,443,094 | A * | 4/1984 | Ricciardi | 101/411 |
| 5,390,911 | A | 2/1995 | Schmid | |
| 5,431,386 | A * | 7/1995 | Blaser | 271/204 |
| 5,558,021 | A * | 9/1996 | Erhard et al. | 101/232 |
| 5,649,483 | A | 7/1997 | Mack et al. | |
| 6,213,462 | B1 * | 4/2001 | Schmidt | 271/204 |
| 6,578,846 | B2 * | 6/2003 | Maul et al. | 271/277 |
| 6,976,674 | B2 * | 12/2005 | Honegger | 271/204 |
| 7,004,463 | B2 * | 2/2006 | Eugster et al. | 271/187 |
| 7,048,110 | B2 * | 5/2006 | Hachiya et al. | 198/470.1 |
| 7,073,788 | B2 * | 7/2006 | Donges et al. | 271/207 |
| 7,198,267 | B2 * | 4/2007 | Forch et al. | 271/204 |
| 7,261,291 | B2 * | 8/2007 | Forch et al. | 271/183 |

FOREIGN PATENT DOCUMENTS

| | | |
|---|---|---|
| DE | 42 26 842 C1 | 2/1994 |
| DE | 43 02 125 A1 | 7/1994 |
| DE | 43 02 127 A1 | 7/1994 |
| DE | 195 19 374 A1 | 11/1996 |
| DE | 257 815 A1 | 6/1998 |
| DE | 198 19 490 C1 | 10/1999 |
| DE | 101 10 441 A1 | 10/2001 |
| DE | 103 49 668 A1 | 5/2004 |

* cited by examiner

*Primary Examiner*—Patrick H Mackey
*Assistant Examiner*—Luis Gonzalez
(74) *Attorney, Agent, or Firm*—Laurence A. Greenberg; Ralph E. Locher; Werner H. Stemer

(57) ABSTRACT

A sheet-processing machine, in particular a rotary press, has a first gripper system for transporting sheets onto a sheet stack and a second gripper system following the former for accepting selected sheets from the first gripper system. The second gripper system is oriented substantially vertically and it has a drive that can be actuated separately and independently from the first gripper system.

9 Claims, 3 Drawing Sheets

SHEET PROCESSING MACHINE HAVING AN APPARATUS FOR REMOVING SELECTED SHEETS

BACKGROUND OF THE INVENTION

Field of the Invention

The invention lies in the field of sheet-processing and relates, more specifically, to a sheet-processing machine having an apparatus for removing selected sheets.

A machine of the type is known, for example, from the commonly assigned German patent DE 195 19 374 C2 and U.S. Pat. No. 5,649,483. There, the apparatus for singling out selected sheets comprises suction belts which circulate non-uniformly and to which the transport grippers transfer a sheet that is to be removed. During the transfer of the sheet, the suction belts are at the same speed as the transport grippers and convey the sheet in the direction of a support which is arranged, with regard to the processing direction, downstream of a delivery stack which is loaded with the sheets in normal operation, the support being configured in the present case such that it can be pulled out for accommodating removed sheets. The known apparatus is suitable for removing a plurality of sheets which follow one another, on account of a particular law of motion which is forced onto the suction belts. According to this law of motion, the suction belts are initially accelerated beyond the speed of the transport grippers after a sheet has been transferred. If a trailing section of the respective sheet has reached the suction belts, the latter are retarded to a delivery speed which is considerably lower than the speed of the transport grippers and at which the sheets are then transferred to the abovementioned support.

Commonly assigned German patent application DE 101 10 441 A1 likewise discloses a sheet-processing machine of the type which is mentioned in the introduction. The apparatus provided therein for removing selected sheets operates once again with suction belts which transfer the relevant sheets from the transport grippers, convey them beyond a delivery stack and finally transfer them at a delivery speed to a support. The guide means which are assigned to the suction belts make it clear that the process management of the removal of selected sheets by means of the suction belts provided for this purpose in the prior art proves problematic.

SUMMARY OF THE INVENTION

It is accordingly an object of the invention to provide a sheet-processing machine with a device for singling out selected sheets which overcomes the above-mentioned disadvantages of the heretofore-known devices and methods of this general type and which provides for reliable process removal and user friendly withdrawal of removed sheets are possible.

With the foregoing and other objects in view there is provided, in accordance with the invention, a sheet-processing machine, in particular a rotary printing press, comprising:

a first gripper system configured to transport sheets in a transport direction, the first gripper system including at least one transport gripper and sheet trailing edge grippers for fixing a sheet trailing edge;

an apparatus for removing selected sheets, the apparatus having an aftergripper system for accepting the selected sheets from the first gripper system; and a drive connected to drive the aftergripper system separately from the first gripper system when a sheet is transferred from the transport gripper to the aftergripper system.

To this extent, the removal is particularly advantageously configured as a reliable process if there is positive guidance of the sheets on gripper edges of the transport grippers as far as the withdrawal of the selected sheets which are guided initially by means of the transport grippers.

In a first refinement, the positively guided gripper edges are leading edge grippers which lead in the delivery transport direction, while, in a second refinement, the trailing edges of the corresponding sheet are also guided positively by means of trailing edge grippers as far as the withdrawal of the sheets, the sheets being released, however, at the leading gripper edges before their withdrawal. In both refinements, the sheets are made available for withdrawal in a suspended manner, with the result that a support for removed sheets can be omitted, which support would extend that setdown area for the machine which is required at least for the duration of the withdrawal and the removal of removed sheets, and which would extend at least the extent of the sheets in the conveying direction having a maximum processible format, and which would need to be kept ready in machines which are configured according to the prior art for sheet removal. In the refinement according to the invention of the machine which is mentioned in the introduction, the result is a substantially smaller required extension of the setdown area compared with a machine having a known apparatus for removing selected sheets.

In accordance with a preferred implementation of the invention, therefore, the aftergripper system is arranged substantially vertically.

In accordance with an additional feature of the invention, the aftergripper system includes a housing with a pivotable cover. In an advantageous embodiment, a blast air apparatus is disposed to apply blast air to the sheet in a waiting and holding position. A part of the blast air apparatus may be mounted to be pivotable jointly with the cover.

Other features which are considered as characteristic for the invention are set forth in the appended claims.

Although the invention is illustrated and described herein as embodied in a sheet-processing machine having an apparatus for removing selected sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
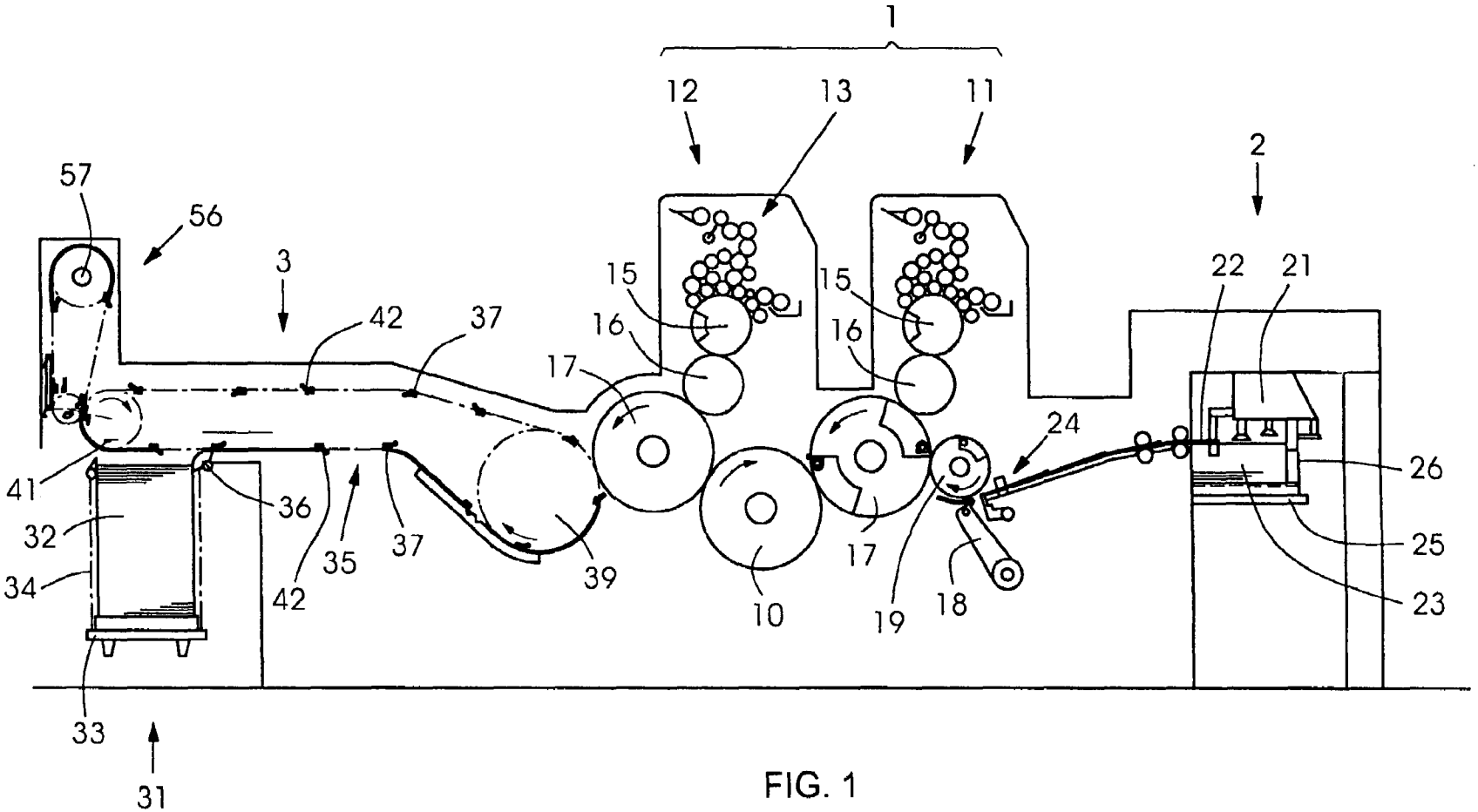
FIG. 1 is a diagrammatic section of a sheet-fed rotary press.
Figure 2:
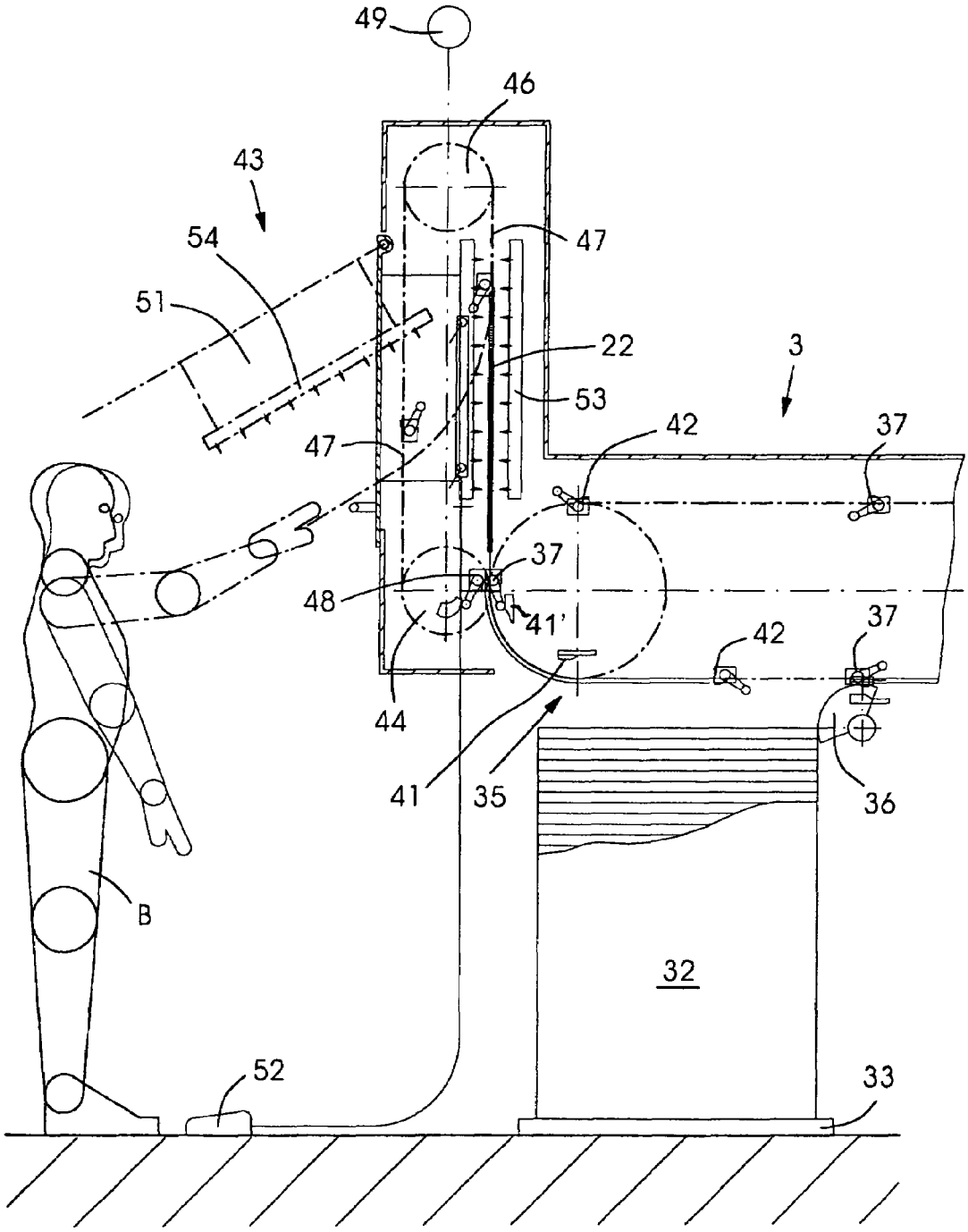
FIG. 2 is a side view elevation of a first exemplary embodiment of a sheet removal apparatus according to the invention.

Referring now to the figures of the drawing in detail and first, particularly, to FIG. 1 thereof, there is shown a diagram of a sheet-processing rotary press with a machine section 1 having, by way of example, two processing stations in the form of printing units 11 and 12. In such a printing machine it is possible to print two colors. A further printing unit is to be provided for each further color. In each case one further processing station is to be provided for further process steps, such as varnishing, intermediate drying, perforating, etc. In the case which is shown by way of example, the printing units 11 and 12 operate according to the wet offset process and accordingly comprise in each case one inking unit 13 and one damping unit 14, one plate cylinder 15 which is connected to the latter, one blanket cylinder 16 which rolls on the plate cylinder 15 during operation, and one impression cylinder 17 which guides a respective sheet 22.

In order to load the printing units 11 and 12 with the sheets 22, a feeder 2 is provided which grips a respectively uppermost sheet 22 from a stack 23 by means of a separating device 21 and transfers it to a transport and aligning apparatus 24 which aligns a respective sheet, which leads in the processing direction, of the sheets that have been separated to form an overlapping formation, an imbricated stream, against leading edge stops and at least one lateral stop after the sheet has been transported, in particular by way of a suction belt table, in the direction of the leading edge stops.

An oscillating pregripper 18 which is assigned to the first processing station, here the printing unit 11, accepts the respective aligned sheet 22 and transfers it to a feed drum 19 which for its part transfers the sheet to the impression cylinder 17 of the printing unit 11. After passing through the press nip of the printing unit 11, the impression cylinder 17 of the latter transfers the sheet 22 to a transfer apparatus in the form of a sheet guiding drum 10 which is connected between the impression cylinders 17 of the two printing units 11 and 12. In the case of a machine which is configured for recto and verso printing, a turner device is provided, instead, which can be switched over between recto printing operation and recto and verso printing operation. The impression cylinder 17 of the printing unit 12 accepts the sheet 22 from the sheet guiding drum 10, guides it through the further press nip and then transfers it to a conveyor 35 which is arranged in a delivery 3 and transports the sheets 22 at the processing speed in a conveying direction along a conveying section and, after passing the conveying section, transfers them for braking to a delivery speed to a sheet brake 36 which releases the sheets 22 finally in order to form a printed material stack 32.

The conveyor 35 is equipped with gripper bars 37, on which grippers are arranged which are normally closed under spring force and are opened temporarily by rotation of a gripper shaft which bears the grippers by means of a cam follower assembly that is disposed on the gripper shaft and by means of a gripper opening cam 41 which deflects the cam follower assembly accordingly when the cam follower runs up onto the cam 41.

The gripper bar 37 holds the sheet which is to be transported firmly at one leading edge with its grippers, while the trailing edge of the sheet 22 is held by a gripper bar 42 which is conveyed on the same movement path.

In order to remove a selected sample sheet 22, the latter is fed to a second conveyor 43 or a second conveying section 43. In this case, the opening cam 41 is bypassed and sheet is transported farther until the leading edge gripper 37 is opened at an opening cam 41' that is disposed at the transfer point (at approx. 9 o'clock in the drawing) to the second conveying section 43. There, the leading edge of the sheet 22 that is being singled out is gripped by a leading edge gripper 48 of the second conveying section 43. The second conveying section 43 comprises substantially a chain conveyor having two deflection rollers 44, 46 and a plurality of gripper bars 48 which are fastened to the chains 47 of the conveyor 43. In contrast to the first conveyor 35, the second conveyor 43 has substantially a vertical orientation, with the result that a sheet 22 which is conveyed horizontally by the first chain conveyor 35 is moved into a vertical position by the second chain conveyor 43. The gripper bars 48 accept the leading edge of the sheet 22 from the gripper bar 37 at transport speed and transport the sheet into a waiting and holding position above the sheet transfer position. The second conveying system 43 has a drive 49, for example an electric motor, which can be actuated separately from the first conveying section. After the sample sheet 22 has been accepted by the gripper bars 48 of the second conveying section 43, the drive 49 is braked until the sample sheet 22 is made available in a vertical orientation in the waiting and holding position. A protective cover 51 which is arranged vertically in front of the conveying section 43 is suspended pivotably and can be opened in order to withdraw the sample sheet 22.

A blast air device 53, 54 is provided in the vertical waiting and holding position of the sample sheet 22, the blast air device blowing out blast air, preferably throttled blast air, in a manner which is oriented in each case at the upper and/or lower side of the sample sheet 22. The blast air device comprises in each case a stationary blower box 53 and a pivotally arranged blower box 54 which is mounted on the protective cover 51.

On opening the protective cover 51, the operator is able to grasp the sheet 22 at its trailing edge. Upon releasing the leading edge of the sheet—for example by way of a foot pedal 52 that actuates a cam plate which, in turn, forces the leading edge gripper 48 into its open position—the operator can simply remove the sheet 22 for inspection.

Figure 3:
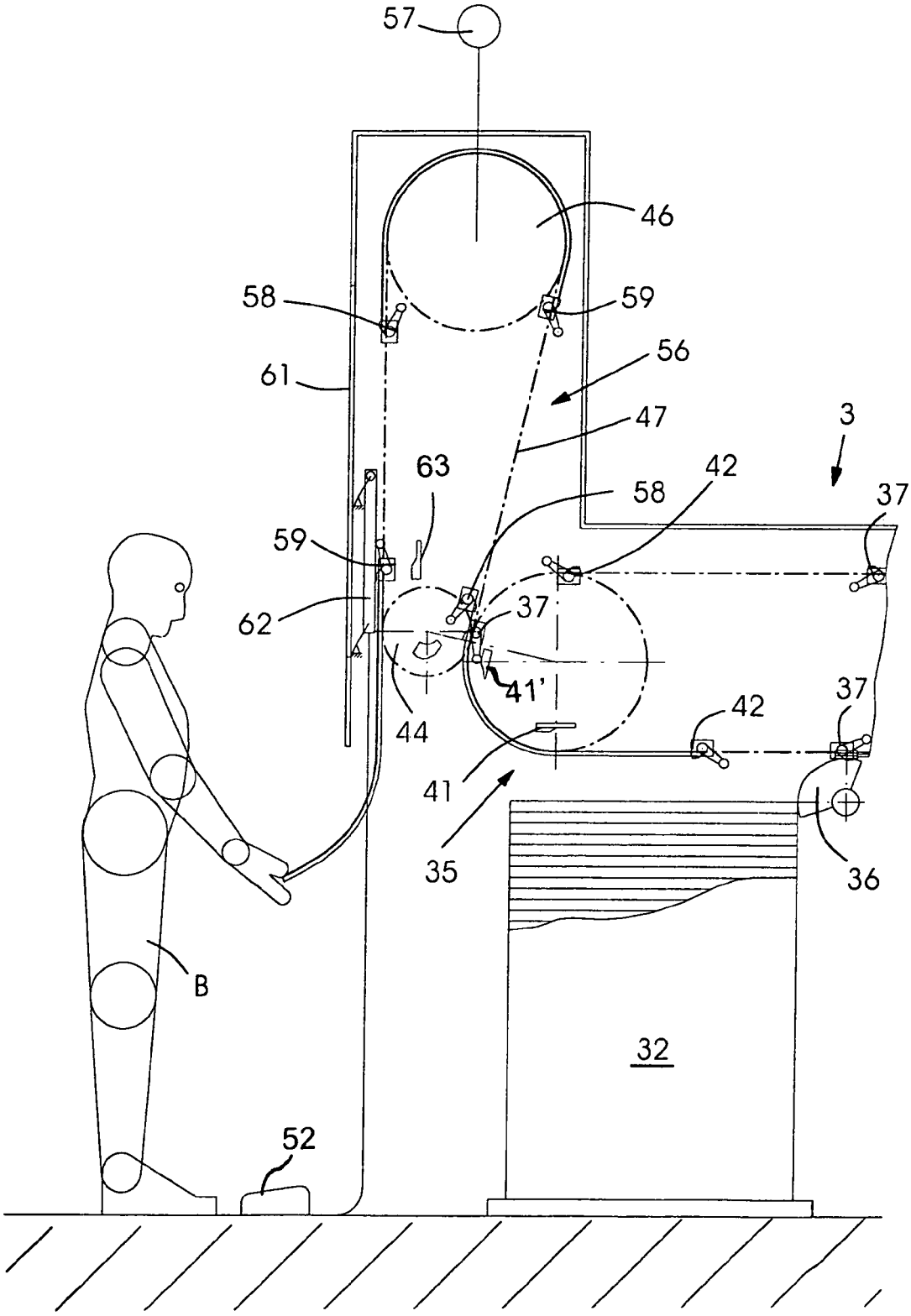
FIG. 3 is a similar side view of a second exemplary embodiment of a sheet removal apparatus according to the invention.

In a second exemplary embodiment according to FIG. 3, there is provision for the horizontally arranged first conveyor 35 to be equipped with gripper bars 37 for the leading edge of the sheet and additionally with gripper bars 42 for the trailing edge of the sheet. Like the second conveyor 43 of the first exemplary embodiment, a second conveyor 56 is arranged substantially vertically. Provided gripper bars 58 of the second conveyor 56 accept the sample sheet 22 at its leading edge and transport it substantially vertically upward out of the horizontal conveying plane. Here, the gripper bar 59 accepts the trailing edge of the sample sheet 22 from the gripper bar 42 of the first conveyor 35. A separate drive 57, for example an electric motor, for the second conveying section 56 conveys the sample sheet 22 around a deflection wheel 46 into a waiting and holding position, in which the leading edge of the sample sheet 22 is situated substantially vertically below the trailing edge of the sample sheet 22. The printed upper side of the sheet 22 which normally lies on the sheet stack 32 such that it points upward can then be inspected by the operator B through, for example, a protection device 61 which is configured as a glass pane or a plastic pane.

A cam plate 62 which can be actuated by the operator B, for example by depressing the foot pedal 52, releases the trailing edge of the sample sheet 22 for the envisaged withdrawal, while the leading edge has already been opened in the waiting and holding position by a stationary control cam 63 which acts on the closing mechanism of the gripper bar 58.

This application claims the priority, under 35 U.S.C. § 119, of German patent application No. 10 2005 003 588.4, filed Jan. 26, 2005; the entire disclosure of the prior application is herewith incorporated by reference.

We claim:

1. A sheet-processing machine, comprising:

a first gripper system configured to transport sheets in a transport direction, said first gripper system including at least one transport gripper and sheet trailing edge grippers for fixing a sheet trailing edge, and said first gripper system being disposed on first chain carried gripper bars;

an apparatus for removing selected sheets, said apparatus having an aftergripper system for accepting the selected sheets from said first gripper system, said aftergripper system being disposed on second chain carried gripper bars; and a drive connected to drive said aftergripper system separately from said first gripper system when a sheet is transferred from said transport gripper to said aftergripper system.

2. The sheet-processing machine according to claim 1, wherein said first gripper system is integrated in, and disposed to receive printed sheets from, a rotary press.

3. The sheet-processing machine according to claim 1, wherein said aftergripper system is arranged substantially vertically.

4. The sheet-processing machine according to claim 2, wherein said aftergripper system includes trailing edge grippers disposed to accept the sheet trailing edge from said sheet trailing edge grippers of said first gripper system.

5. The sheet-processing machine according to claim 1, wherein said aftergripper system includes a housing with a pivotable cover.

6. The sheet-processing machine according to claim 1, which further comprises a blast air apparatus disposed to apply blast air to the sheet in a waiting and holding position.

7. A sheet-processing machine, comprising:

a first gripper system configured to transport sheets in a transport direction, said first gripper system including at least one transport gripper and sheet trailing edge grippers for fixing a sheet trailing edge;

an apparatus for removing selected sheets, said apparatus having an aftergripper system for accepting the selected sheets from said first gripper system;

a drive connected to drive said aftergripper system separately from said first gripper system when a sheet is transferred from said transport gripper to said aftergripper system;

a blast air apparatus disposed for applying blast air to the sheet in a waiting and holding position; and said aftergripper system including a housing with a pivotable cover and a part of said blast air apparatus being mounted to be pivotable jointly with said cover.

8. The sheet-processing machine according to claim 1, wherein said aftergripper system includes trailing edge grippers disposed for accepting the sheet trailing edge from said sheet trailing edge grippers of said first gripper system.

9. A sheet-processing machine, comprising:

a first gripper system configured to transport sheets in a transport direction, said first gripper system including at least one transport gripper and sheet trailing edge grippers for fixing a sheet trailing edge, said first gripper system being part of a first chain conveyor;

an apparatus for removing selected sheets, said apparatus having an aftergripper system for accepting the selected sheets from said first gripper system, and said aftergripper system being past of another chain conveyor; and a drive connected to drive said aftergripper system separately from said first gripper system when a sheet is transferred from said transport gripper to said aftergripper system.

* * * * *